US005313816A

United States Patent [19]

Schubert et al.

[11] Patent Number: 5,313,816

[45] Date of Patent: May 24, 1994

[54] FORGING MACHINE WITH STROKE ADJUSTMENT MEANS

[75] Inventors: Peter Schubert, Kaarst; Hans-Albert Schubert, Dusseldorf, both of Fed. Rep. of Germany

[73] Assignee: SMS Hasenclever GmbH, Fed. Rep. of Germany

[21] Appl. No.: 998,592

[22] Filed: Dec. 30, 1992

[30] Foreign Application Priority Data

Dec. 30, 1991 [DE] Fed. Rep. of Germany ..... 4143176

[51] Int. Cl.[5] ..... B21J 7/02

[52] U.S. Cl. ..... 72/402; 72/446; 72/453.01

[58] Field of Search ..... 72/402, 446, 447, 453.01

[56] References Cited

U.S. PATENT DOCUMENTS

| | | | |
|---|---|---|---|
| 3,681,966 | 8/1972 | Kralowetz et al. | 72/402 |
| 4,796,456 | 1/1989 | Schmoll et al. | 72/402 |
| 4,813,263 | 3/1989 | Schubert et al. | 72/402 |
| 4,831,864 | 5/1989 | Schmoll et al. | 72/402 |
| 4,905,495 | 3/1990 | Pahnke | 72/402 |
| 4,941,342 | 7/1990 | Herndl et al. | 72/402 |

FOREIGN PATENT DOCUMENTS

| | | |
|---|---|---|
| 228658 | 7/1987 | European Pat. Off. . |
| 0228030 | 4/1991 | European Pat. Off. . |
| 1298498 | 7/1969 | Fed. Rep. of Germany . |
| 3738217 | 7/1988 | Fed. Rep. of Germany . |

*Primary Examiner*—David Jones

*Attorney, Agent, or Firm*—Jacobson, Price, Holman & Stern

[57] ABSTRACT

A forging machine has a machine frame (1), radial forging rams (2) each adapted to carry a die (5), distributed angularly in a common working plane around the system axis (5); radial pressure-fluid piston (12) and cylinder (11) units on the machine frame, each with its cylinder forming or connected to a respective ram and having a stroke corresponding to the required ram stroke; and crossheads (15) mounted adjustably on the machine frame and each supporting the piston of a respective piston and cylinder unit. The stroke position of each ram is adjustable by adjustment of the crosshead towards and away from the system axis. A flange (19) is provided on each cylinder (11) and, a ring (17) extends around each ram, at the radially inner side of the flange (19), and is connected to the adjustable crosshead. Ram return piston and cylinder units (20,22) are disposed between the ring and flange.

4 Claims, 6 Drawing Sheets

FORGING MACHINE WITH STROKE ADJUSTMENT MEANS

BACKGROUND OF THE INVENTION

This invention relates to forging machines and more particularly to such machines having an adjustable stroke.

For the forging of workpieces having a distinct longitudinal axis, forging machines are employed which are provided with three or more rams equipped with dies, and distributed within a plane, and in particular with four such rams at 90° to one another in an X arrangement. These rams act radially on the workpiece which is guided longitudinally along the system axis. The rams are guided in the machine frame and are constructed at their ends remote from the dies as cylinders of piston-and-cylinder units, or are connected to such units. The piston-and-cylinder units are dimensioned in accordance with the working stroke of the ram in order to minimize the compression volume, this being a major prerequisite for rapid stroke and a defined stroke end position. The stroking position, by which the pass contour produced by the dies is determined, is adjustable by means of crossheads which support the pistons of the piston-and-cylinder units and which are adjustable in the machine frame. A closed pass contour, as is necessary for certain types of work, is obtained through the use of replaceable sets of dies of the appropriate dimensions as in Peter Metzger, "Die numerisch gesteuerte Radial-Umformmaschine und ihr Einsatz im Rahmen einer flexiblen Fertigung" ["The numerically controlled radial forming machine and its employment in flexible manufacturing"], volume 5 of the reports issued by the Institut für Umformtechnik [Institute of Forming Technology] of the University of Stuttgart, publishers: Springer-Verlag, Berlin - Heidelberg - New York, 1980, pages 36–39, 67–69, 112, 113, 129), or by means of dies which are transversely adjustable at the rams via die holders, said dies featuring mutually overlapping work and side surfaces and being adjusted such that they form a closed pass contour in the relevant stroke end position (European Application No. EP 0 228 030 B1; U.S. Pat. Nos. 4,796,456 and 4,831,864).

In order to achieve a compact design of such forging machines and, at the same time, minimum-clearance ram guidance, the rams according to European Application No. EP 0 228 658 B1 are constructed as pistons or cylinders of piston-and-cylinder units and directly guided, i.e. not offset, in the machine frame. Here — if double-acting pistons are to be avoided owing to the more complicated seals required — the pistons or cylinders serving as rams have to be provided with shafts which pass through the complementary cylinders or pistons, and the supporting crossheads which are adjustable in the machine frame, by means of which shafts the piston-and-cylinder units for the ram return strokes operate.

SUMMARY OF THE INVENTION

The object of the invention is to avoid not only double-acting pistons but also ram return strokes effected via shafts. This object is achieved in that, on the basis of rams constructed as cylinders or connected to cylinders, according to the invention the rams, or the cylinders connected to them, are in each case provided with, or connected to, a flange and surrounded in each case by a ring engaging behind the flange, the ring and the crosshead provided for stroke position adjustment being interconnected, and piston-and-cylinder units for the return stroke of the rams are arranged between each ring and the associated flange.

In order to further improve accessibility to the seals of the main and return pistons, provision is made, in accordance with a further feature of the invention, for detachable connections to be provided between the rings and the associated crossheads, and for sufficient removability of the ring concerned, with the cylinder or ram surrounded by it, from the associated crosshead with the plunger piston which it supports, such that the seal between the plunger piston and cylinder can be replaced without any further dismantling and re-assembly.

BRIEF DESCRIPTION OF THE DRAWINGS

The invention will now be described in detail with reference to the accompanying drawings drawings which show an embodiment of the invention by way of example and wherein.

DESCRIPTION OF PREFERRED EMBODIMENTS

Figure 1:
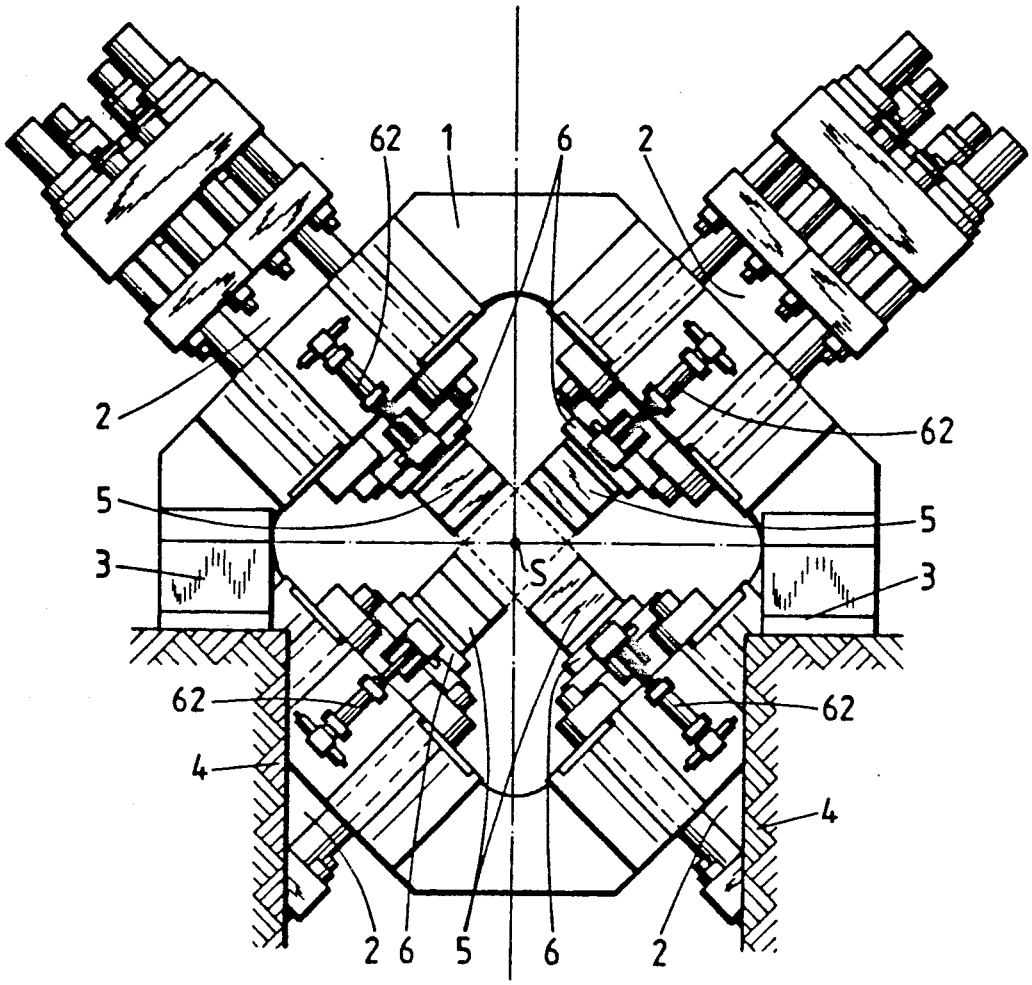
FIG. 1 is a general elevational view of a forging machine of the invention in the direction of the system axis S.
Figure 2:
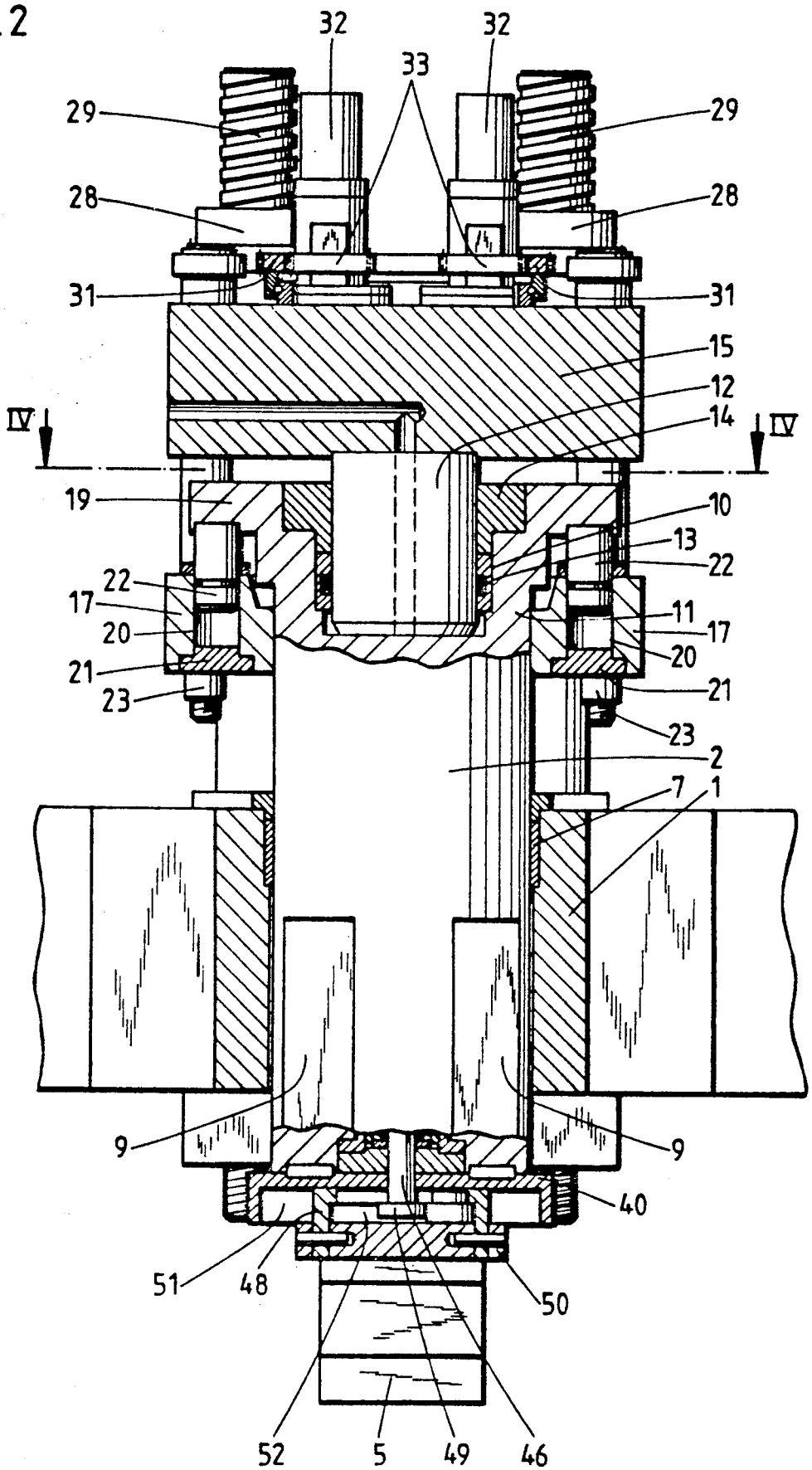
FIG. 2 is an enlarged cross-sectional view showing in detail a ram of FIG. 1 taken along the line II—II in FIG. 3, i.e. along the working plane in which the dies are adjusted.
Figure 3:
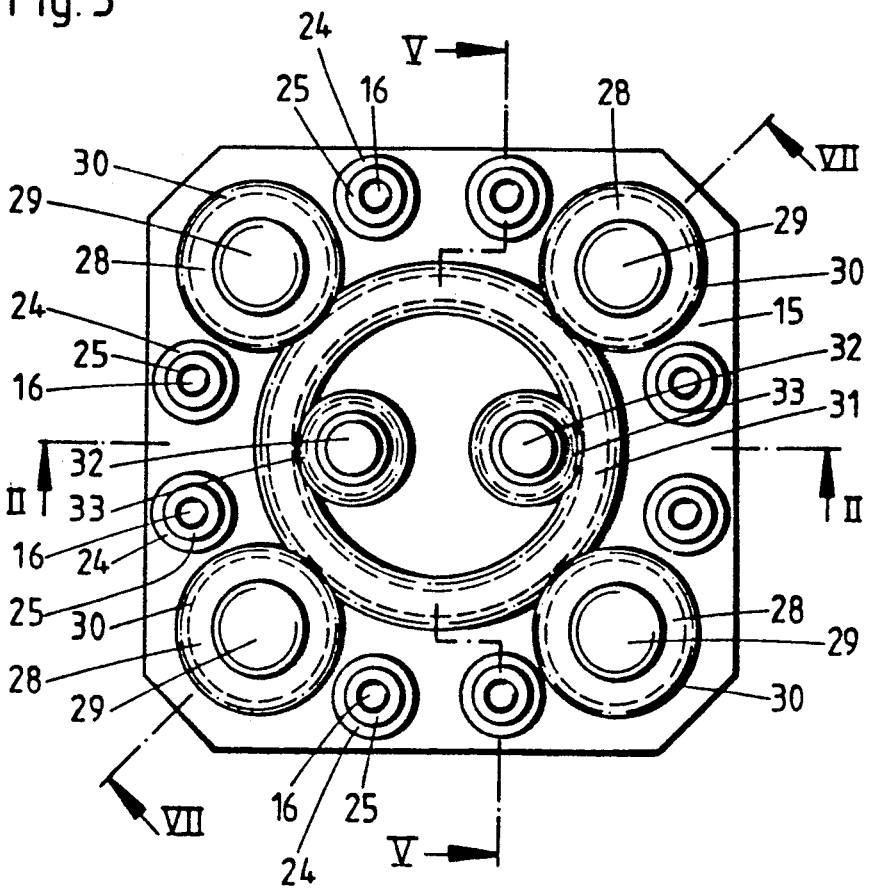
FIG. 3 is a top view of FIG. 2.
Figure 4:
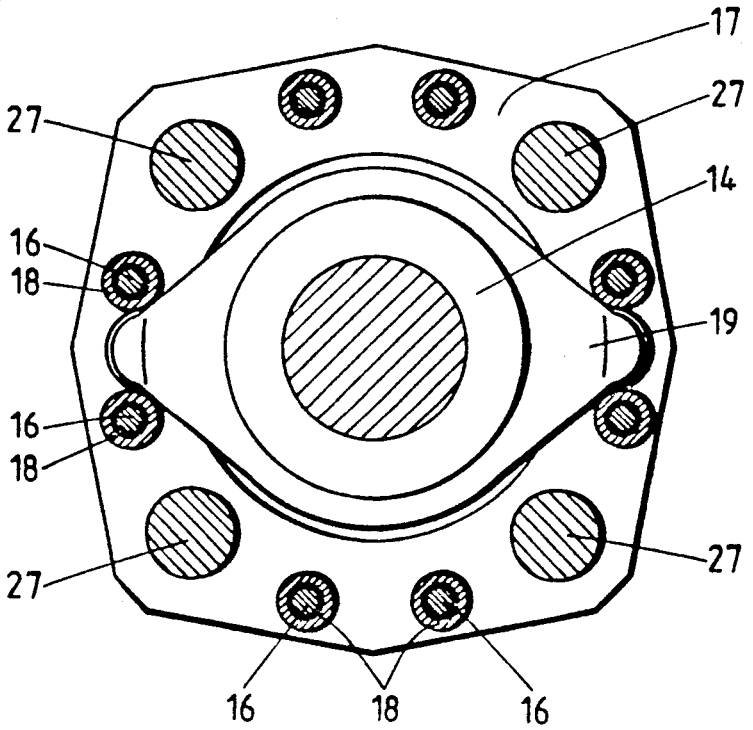
FIG. 4 is a cross-sectional view taken along the line IV—IV in FIG. 2.

The forging machine depicted in FIG. 1 as viewed in the direction of the system axis S comprises a frame 1 which guides four rams 2 in an X arrangement, grouping said rams 2 together with their drives so that the rams 2 move radially to the system axis S in a working plane perpendicular thereto. The frame 1 is provided on both sides front and rear with extensions 3 by means of which it is supported on piers 4 of a foundation. Each ram 2 is provided at its end face with a die 5, and in the stroke end positions of the rams 2, the dies 5 form a closed pass contour. In order to be able to form pass contours of which the side lengths are smaller than the width of the dies 5, the dies 5 are supported by holders 6 which are adjustable transverse to the axes of the rams 2 in the working plane, and the stroke end positions of the rams 2 are adjustable so that the dies form a closed pass contour in their respective stroke end positions in the manner known from EP 0 228 030 B1 with the portion of their work surface exceeding the pass size lying adjacent a side surface of an adjacent die.

Another possibility of achieving a closed pass contour, at least in certain areas, and of preventing die collision, consists in that, during performance of the work, a continuous collision monitoring function is implemented, and in that, by means of a die change system associated with the forging machine, rapid die changing is performed as soon as the dimensions of a die set are no longer reconcilable with the workpiece size to be formed, because either there is a danger of the dies colliding, or the dies no longer sufficiently enclose a pass contour, in the manner known from the publication mentioned above (Peter Metzger, "Die numerisch gesteuerte Radial-Umformmaschine und ihr Einsatz im Rahmen einer flexiblen Fertigung"). The invention includes an embodiment which is devised for a die change operation instead of a transverse displacement of the dies.

Figure 5:
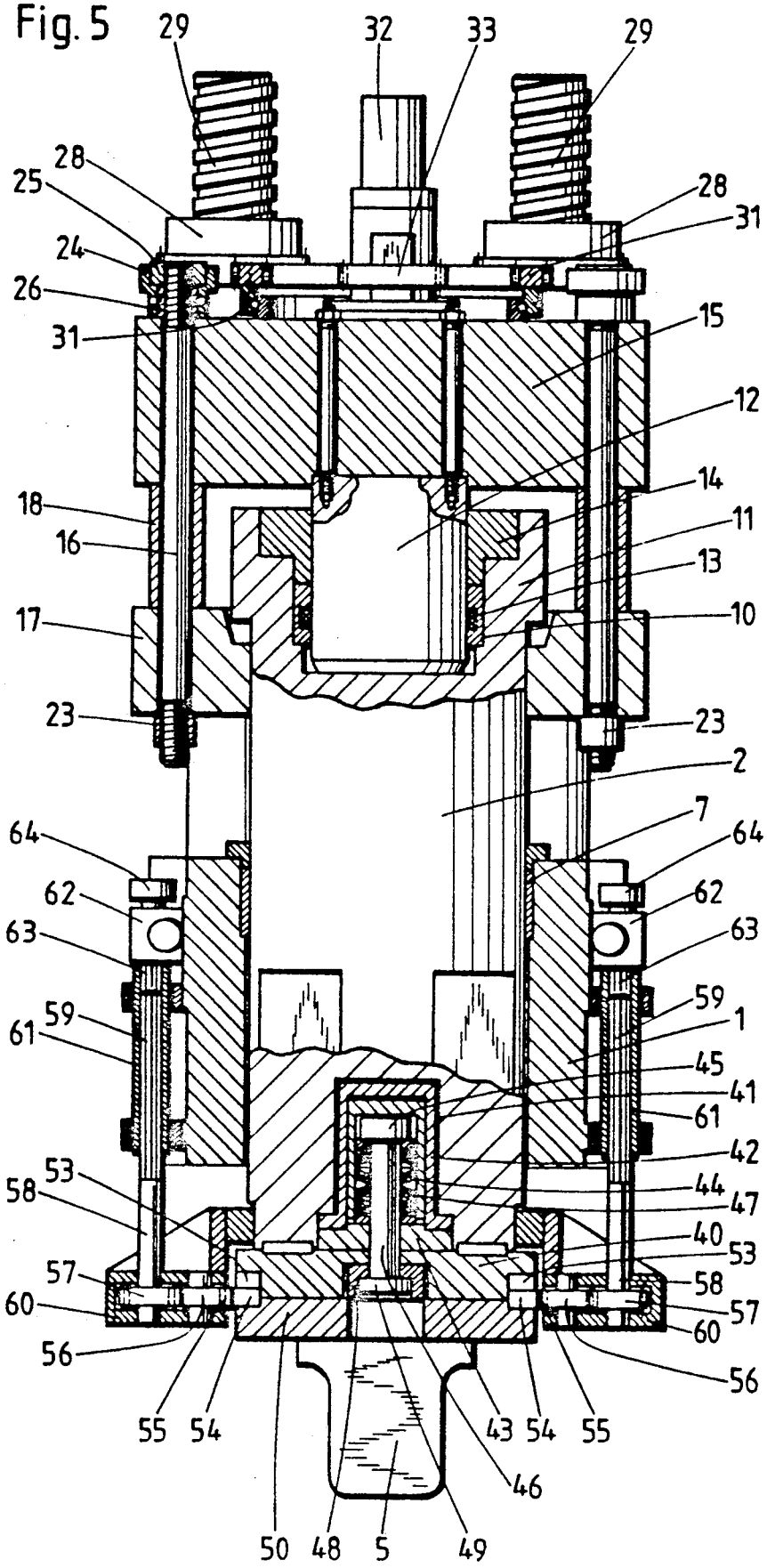
FIG. 5 is a view similar to FIG. 2 but taken along the line V—V in FIG. 3, i.e. a sectional plane offset at 90° to the sectional plane of FIG. 2.
Figure 6:
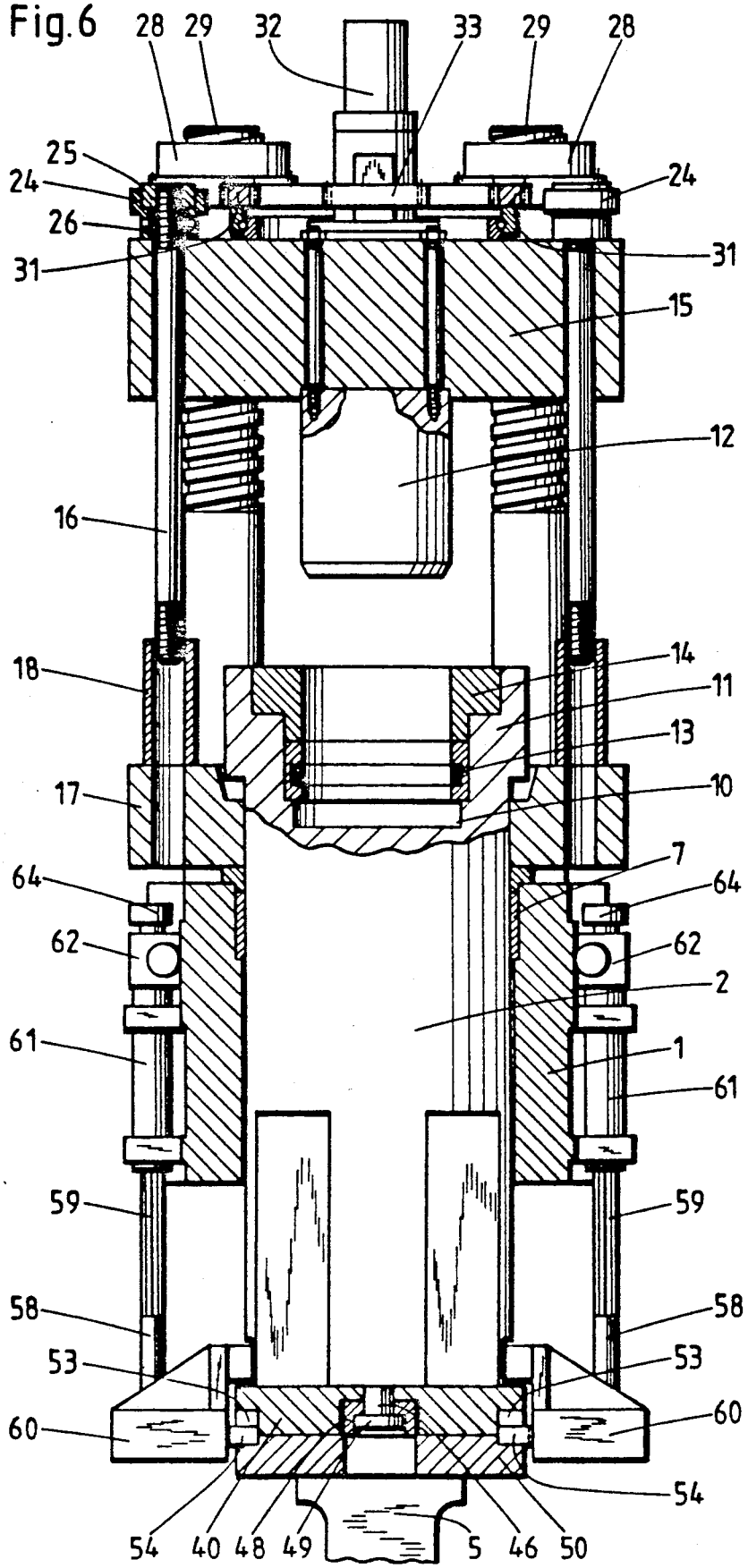
FIG. 6 is a sectional view corresponding to FIG. 5 but with the plunger piston extended from the cylinder of the piston-and-cylinder unit.
Figure 7:
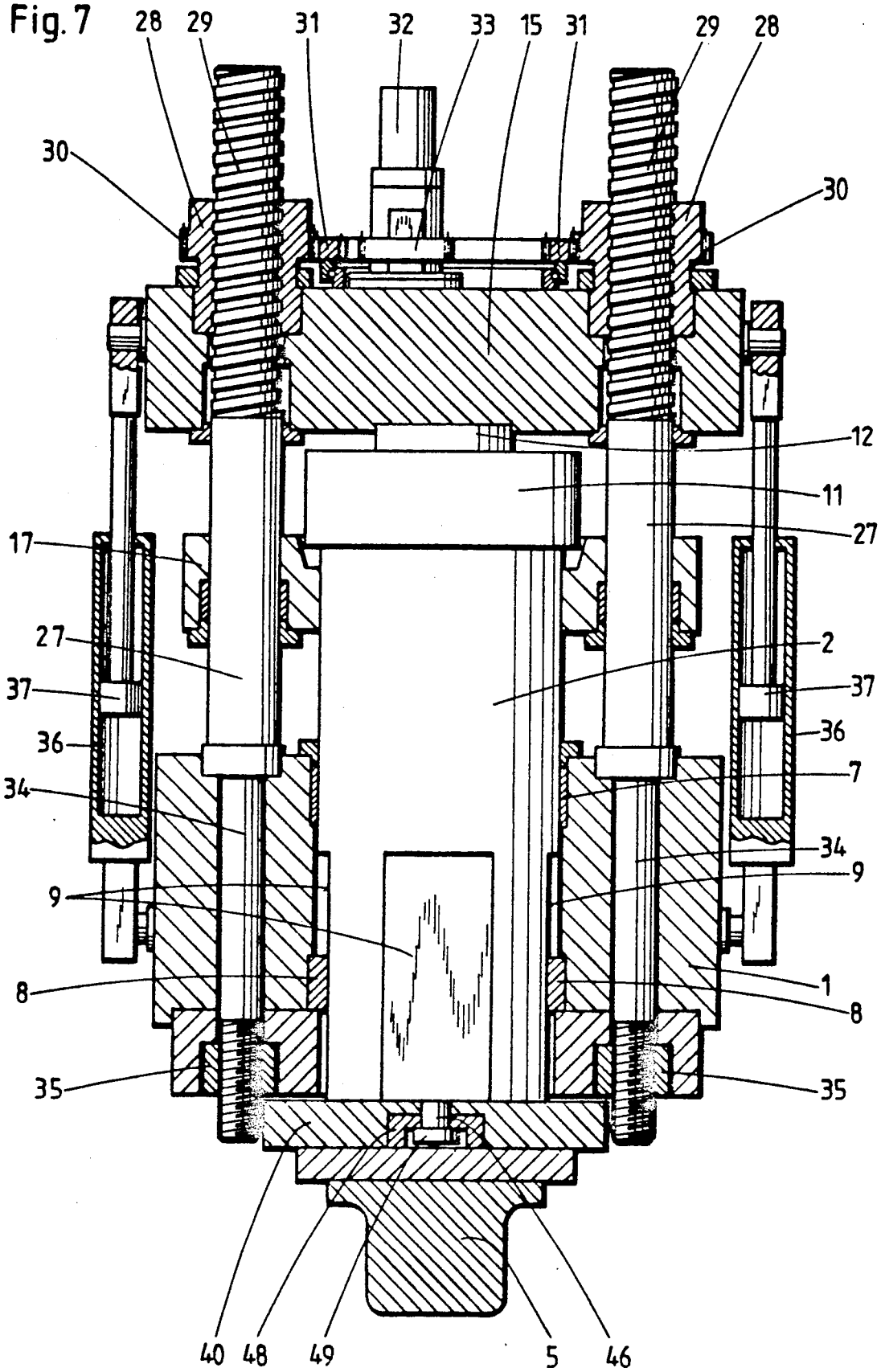
FIG. 7 is a view similar to FIG. 2 but taken along the line VII—VII in FIG. 3.

In larger-scale details, FIGS. 2 to 7 show a single ram 2 which is guided axially movably by a guide bushing 7 and — as depicted in FIG. 7 — by guide plates 8 which bear against the flats 9 of the ram 2, said guide plates 8 interacting with the flats 9 to prevent the ram 2 from rotating. At its end remote from the system axis S, the ram 2 has a stepped bore 10 forming a cylinder 11 which receives a plunger piston 12. A ring seal 13 is inserted at a shoulder of the bore 10 to provide a seal against the plunger piston 12, and is held in this position by a ring 14. The plunger piston 12 is supported on a crosshead 15, the distance of which from the frame 1 is adjustable, thus enabling the stroke position of the cylinder 11, and therefore that of the ram 2, to be varied, while the plunger piston 12 and cylinder 11 are sized solely in accordance with the working stroke of the ram 2. The stroke position defines, as a result of the respective end position of the ram 2 with its die 5, the resultant workpiece dimension. The crosshead 15 is connected by tie rods 16 to a ring 17, of which the distance of which from the crosshead 15 is determined by spacer sleeves 18. The ring 17 surrounds the ram 2/cylinder 11 and engages behind a flange 19 at the cylinder 11. The ring 17 is further provided with bores 20 which are closed at one end by covers 21 and which form cylinders for receiving plunger pistons 22. These plunger pistons 22 act against the flange 19 at the ram 2/cylinder 11 for the return strokes thereof.

For replacing the ring seal 13, the ring 17 is detachably connected to the crosshead 15, for which purpose the nuts 23 are removed from the tie rods 16. This operation is facilitated by the fact that the tie rods 16 can be hydraulically preloaded by pistons 25, these being actuated in cylinders 24 and connected to the tie rods 16, so that, with the tie rods 16 preloaded, counter nuts 26 of nuts 23 can be turned without stress. Pressurization of the pistons 25 associated with a ram 2 is performed centrally in a common system for all pistons 25. Once the ring 17 has been separated from the crosshead 15, the cylinder 11 and the plunger piston 12 can also be detached from one another, as depicted in FIG. 6.

The stroke position of a ram 2 can be adjusted by virtue of the above-mentioned adjustability of the associated crosshead 15. For this purpose, as can be seen from FIG. 7, each crosshead 15 is connected by four tie-bars 27 to the frame 1, through nuts 28 which are rotatably supported in the crosshead 15, which brace the crosshead 15 against the press force exerted at the plunger piston 12, and which can rotate on the threaded rods 29 of the tie-bars 27. The threaded nuts 28 are provided with external toothing 30 and are rotated in unison for each crosshead 15 by a ring gear 31, which in turn is rotated by geared motors 32, the drive pinion 33 of each of which engages in the internal toothing of the double-toothed ring gear 31. The stroke position of each ram 2 is thus adjustable and can be locked by means of a brake device in the gear motors 32. The tie-bars 27 are secured by means of shafts 34 and nuts 35 to the frame 1. The units formed from the cylinders 36 connected to the frame 1 and the pistons 37 connected to the crosshead 15 serve to preload the crosshead 15 in the direction of the working pressure against backlash of the nuts 28 on the threaded rods 29.

As is particularly apparent from FIG. 5, the die 5 associated with each ram 2 is connected to the ram 2 by a clamping device which facilitates a transverse displacement or a change Of die 5 within a short time and without lengthy interruptions to work. The ram 2, which is provided at its end face supporting the die 5 with a head plate 40, is also provided at the same end face for die displacement or change, with a bore 41 into which a cylinder 42 with cover 43 is inserted. A plunger piston 44 is inserted in the cylinder 42, said plunger piston 44 having a hollow which receives one end of a tension pin 46 provided with a collar 45, and, between the collar 45 and the cover 43, an assembly of cup springs 47. The tension pin 46 passes through the head plate 40 and a clamping element 48 located in a groove of the head plate 40, on which clamping element 48 a collar nut 49 associated with the tension pin 46 acts. The clamping element 48 is connected to a holder 50 which supports the die 5. Pressurization of plunger piston 44 causes the assembly of cup springs 47 to be compressed, the clamping element 48 to be unloaded and the holder 50 to be pushed away from the head plate 40. The holder 50 with the die 5 can now be transversely displaced or replaced by another holder 50 with die 5 by a die change system. Once the die 5 has been moved to its new position or replaced by a die of different dimension, the plunger piston is depressurized again and the assembly of cup springs 47 clamps the holder 50 and die 5 once more against the head plate 40 at the ram 2.

For the purpose of transversely displacing the dies 5 in the illustrated embodiment, each head plate 40 of a ram 2 is provided with a longitudinal groove 51 for receiving the clamping element 48, and each clamping element is in turn provided with a longitudinal groove 52 for receiving the tension pin 46 with its collar nut 49, with the longitudinal extension of the grooves 51 and 52 running in the working plane common to the rams 2. Parallel to the grooves 51 and 52, the head plate 40 is provided with lateral strips 53, and the holder 50 is provided with lateral strips 54, which strips are provided with fine serrations facing one another. The lateral strips 54 are provided with toothing 55 in which pinions 56 engage which in turn mesh with pinions 57 on shafts 58. A pinion 56, a pinion 57 and a shaft 58 are respectively supported in a gearbox 60 which is connected to the ram 2. Each shaft 58 is provided with a splined end 59 by means of which it engages in a hollow shaft 61 having a splined bore so that the shaft 58 is rotationally coupled thereto yet axially displaceable. Each hollow shaft 61 is driven by an oscillating motor 62 of which one output shaft end 63 engages in the hollow shaft 61 while a second output shaft end actuates a rotary transmitter 64 which indicates and/or controls the lateral displacement of the holder 50 with die 5.

We claim:

1. A forging machine comprising:

a machine frame defining a system axis extending therethrough;

a plurality of forging rams slidably mounted in said frame and disposed radially with respect to said system axis and distributed angularly within a common working plane transverse to said system axis;

a plurality of pressure fluid piston and cylinder units radially disposed on said machine frame, the cylinder of each unit driving a respective one of said rams and having a stroke corresponding to the required ram stroke and a defined stroke end position;

a respective crosshead supporting the piston of a respective piston and cylinder unit and adjustably supported for movement relative to said machine frame toward and away from said system axis for adjusting said stroke end position of a respective one of said cylinders of said piston and cylinder units;

means for mounting a die on each ram;

a flange associated with a cylinder of a respective one of said piston and cylinder units for movement with said ram;

a ring extending around each of said rams at a position between said flange and said system axis;

means for connecting said ring to a respective adjustable crosshead for movement therewith; and at least one ram return piston and cylinder unit disposed and acting between said ring and flange for returning a respective ram after a stroke thereof.

2. A forging machine as claimed in claim 1 wherein:

each ram piston and cylinder unit comprises a plunger piston mounted on the associated crosshead and a seal between the piston and the cylinder;

each ring is detachably secured to the associated crosshead; and when said ring is detached from the associated crosshead, the distance between said ring, with the associated ram surrounded by the ring, and the crosshead can be increased, so that said seal between the piston and cylinder is rendered accessible.

3. A forging machine as claimed in claim 2 wherein said means for connecting each ring to a respective crosshead comprises:

spacing means between said ring and crosshead;

tie rods passing through said spacing means;

nut means releasably securing said tie rods to said ring and crosshead; and centrally controlled hydraulic pistons operatively connected to said nut means at one end of said tie rods, for preloading said tie rods.

4. The forging machine as claimed in claim 1 wherein:

said plurality of rams comprises four rams disposed in an X arrangement, at 90° to one another.

* * * * *